US010960559B2

(12) United States Patent
Kim et al.

(10) Patent No.: US 10,960,559 B2
(45) Date of Patent: Mar. 30, 2021

(54) RAZOR CARTRIDGE

(71) Applicant: DORCO CO., LTD., Seoul (KR)

(72) Inventors: Dong Il Kim, Seoul (KR); Sung Hoon Oh, Seoul (KR)

(73) Assignee: DORCO CO., LTD., Seoul (KR)

( * ) Notice: Subject to any disclaimer, the term of this patent is extended or adjusted under 35 U.S.C. 154(b) by 0 days.

(21) Appl. No.: 16/510,492

(22) Filed: Jul. 12, 2019

(65) Prior Publication Data

US 2020/0031006 A1 Jan. 30, 2020

(30) Foreign Application Priority Data

Jul. 27, 2018 (KR) ..... 10-2018-0087848

(51) Int. Cl.

| | |
|---|---|
| ***B26B 21/40*** | (2006.01) |
| ***B26B 21/56*** | (2006.01) |
| *B26B 21/22* | (2006.01) |
| *B26B 21/44* | (2006.01) |

(52) U.S. Cl.

CPC ..... *B26B 21/4031* (2013.01); *B26B 21/565* (2013.01); *B26B 21/222* (2013.01); *B26B 21/443* (2013.01)

(58) Field of Classification Search

CPC . B26B 21/4031; B26B 21/222; B26B 21/565; B26B 21/443; B26B 21/56

USPC ..... 30/50

See application file for complete search history.

(56) References Cited

U.S. PATENT DOCUMENTS

| | | | | |
|---|---|---|---|---|
| 4,031,620 | A * | 6/1977 | Pomfret | A45D 27/24 30/346.57 |
| 5,687,485 | A | 11/1997 | Shurtleff et al. | |
| 5,761,814 | A | 6/1998 | Anderson et al. | |
| 5,956,848 | A | 9/1999 | Tseng et al. | |
| 5,956,851 | A | 9/1999 | Apprille et al. | |
| 6,041,926 | A | 3/2000 | Petricca et al. | |
| 6,052,903 | A | 4/2000 | Metcalf et al. | |
| 6,185,822 | B1 | 2/2001 | Tseng et al. | |
| 6,212,777 | B1 | 4/2001 | Gilder et al. | |
| 6,442,839 | B1 | 9/2002 | Tseng et al. | |
| 6,516,518 | B1 | 2/2003 | Garraway et al. | |
| 6,612,040 | B2 | 9/2003 | Gilder | |

(Continued)

FOREIGN PATENT DOCUMENTS

| | | |
|---|---|---|
| EP | 3 599 066 A1 * | 1/2020 |
| JP | 2014527453 | 10/2014 |

(Continued)

OTHER PUBLICATIONS

Korean Intellectual Property Office Application No. 10-2018-0087848, Office Action dated Jul. 22, 2019, 5 pages.

(Continued)

*Primary Examiner* — Hwei-Siu C Payer

(74) *Attorney, Agent, or Firm* — Lee, Hong, Degerman, Kang & Waimey

(57) ABSTRACT

The present invention is directed to an arrangement of blades mounted within a razor cartridge. The razor cartridge includes a blade housing; and a plurality of blades including a first blade and a second blade, wherein a thickness of an edge portion of the first blade is less than a thickness of an edge portion of the second blade, and wherein a first span in front of the first blade is less than a second span in front of the second blade.

17 Claims, 14 Drawing Sheets

110

(56) References Cited

U.S. PATENT DOCUMENTS

| | | | | |
|---|---|---|---|---|
| 6,684,513 | B1 | 2/2004 | Clipstone et al. | |
| 2002/0035786 | A1* | 3/2002 | Gilder | B26B 21/4025 30/50 |
| 2007/0193042 | A1* | 8/2007 | Worrick | B26B 21/443 30/527 |
| 2010/0011590 | A1* | 1/2010 | DePuydt | B26B 21/56 30/50 |
| 2010/0269351 | A1* | 10/2010 | Gilder | B26B 21/227 30/50 |
| 2011/0023307 | A1* | 2/2011 | Folio | B26B 21/4025 30/50 |
| 2011/0146079 | A1 | 6/2011 | Clarke et al. | |
| 2014/0026424 | A1 | 1/2014 | Oglesby et al. | |
| 2015/0013169 | A1 | 1/2015 | Warrick | |
| 2016/0167242 | A1* | 6/2016 | Noh | B26B 21/565 30/50 |
| 2019/0061184 | A1* | 2/2019 | Lin | B26B 21/4031 |
| 2020/0031005 | A1* | 1/2020 | Kim | B26B 21/225 |
| 2020/0031006 | A1* | 1/2020 | Kim | B26B 21/565 |

FOREIGN PATENT DOCUMENTS

| | | |
|---|---|---|
| JP | 2015107360 | 6/2015 |
| KR | 1020170023059 | 3/2017 |
| WO | 2012061343 | 5/2012 |

OTHER PUBLICATIONS

European Patent Office Application Serial No. 191882885, Search Report dated Jan. 16, 2020, 5 pages.

The State Intellectual Property Office of the People's Republic of China Application Serial No. 201910504115.7, Office Action dated Sep. 28, 2020, 4 pages.

* cited by examiner

RAZOR CARTRIDGE

CROSS-REFERENCE TO RELATED APPLICATION

Pursuant to 35 U.S.C. § 119(a), this application claims the benefit of earlier filing date and right of priority to Korean Patent Application No. 10-2018-0087848, filed on Jul. 27, 2018, the contents of which are hereby incorporated by reference herein in its entirety.

BACKGROUND OF THE INVENTION

1. Field of the Invention

The present invention relates to a razor cartridge, and more particularly to an arrangement of razor blades mounted in a razor cartridge.

2. Description of the Related Art

A typical razor, commonly known as a wet razor, includes a razor cartridge and a razor handle. Since the razor cartridge is detachable from the razor handle, the user can replace the razor cartridge as needed. Also, in the razor cartridge, a plurality of blades are arranged in a shaving direction.

The shape and dimensions of these razor blades greatly influence the quality of shaving. Generally, the razor blade has a continuously tapered shape that converges toward an ultimate tip. A portion of the blade that is included to the ultimate tip is called a tip edge. A thick and strong tip edge will result in less wear and longer life, but it may also increase the cutting force (cutting resistance) and intensify the effect of tugging and pulling, which may hinder comfortable shaving. In contrast, if the tip edge profile is thin, the cutting force is weakened, but the possibility of breakage or damage of the blade, and thus, longevity of the blade may also be shortened. The possibility of cutting the skin may also be increased. Accordingly, it is necessary to form a cutting edge of the razor blade providing optimum cutting force, comfort in shaving, and service life.

Not only the shape and thickness of such a razor blade, but also the arrangement of the razor blade greatly influence the quality of the shaving. As factors related to the arrangement of the blade, exposure of the blade and the span of the blade may be considered first. First of all, exposure of the blade should be designed to provide a clean yet excellent shaving comfort, minimizing nicks and cuts. The exposure refers to a relative value indicating the position of the ultimate tip of the razor blade with respect to a contact plane defined by connecting the upper end of a first contact member located in front of the blade and the upper end of a second contact member located behind the blade. The exposure may be categorized as positive, neutral, or negative. The exposure has a considerable influence on the shaving performance.

Thus, the razor blade may have a neutral position, or an exposure amount of zero, in which the ultimate tip of the blade is substantially aligned with the contact plane, a positive position, or a positive exposure amount, in which the tip edge of the blade protrudes past the contact plane, or a negative position, or a negative exposure amount, in which the tip edge of the blade is not in contact with the contact plane, but is offset away from a shaving surface.

As a factor affecting the shaving performance, not only the exposure, but also the span between the blades should be considered as an important factor. Generally, when the span is wide, it is advantageous for discharging shaving substances, such as shaving cream, moisture or shaving debris, although the size of the shaver cartridge may become larger, causing skin irritation and cuts and damage to the blades. When the span is narrow, the opposite effects are obtained.

Thus, in order to provide comfort and sufficient shaving performance in shaving, not only the shape and thickness of the razor blade, but also the span of the razor blade needs to be considered. In particular, a correlation between the shape or thickness of the blade and the span of the blade should be sufficiently considered. However, in the conventional razor cartridge, a factor such as the shape or thickness of the blade and a factor such as the span of the blade have been separately considered, but a correlation between the two factors and the influence of the correlation on the shaving comfort or shaving performance have not been fully considered.

SUMMARY OF THE INVENTION

Therefore, the present invention has been made in view of the above problems, and it is an object of the present invention to provide a razor cartridge in which a razor blade is arranged and allowed to have a suitable span according to the shape and thickness of the razor blade to improve both shaving comfort and shaving performance.

It is another object of the present invention to derive a preferable correlation among the thickness, arrangement and span of each blade in a razor cartridge having both a thin razor blade and a thick razor blade.

It will be appreciated by persons skilled in the art that the objects that can be achieved with the present invention are not limited to what has been particularly described hereinabove and other objects that can be achieved with the present invention will be more clearly understood from the following detailed description.

In accordance with an aspect of the present invention, the above and other objects can be accomplished by the provision of a razor cartridge including a blade housing; and a plurality of blades including a first blade and a second blade, wherein a thickness of an edge portion of the first blade is less than a thickness of an edge portion of the second blade, and wherein a first span in front of the first blade is less than a second span in front of the second blade.

In accordance with another aspect of the present invention, the above and other objects can be accomplished by the provision of a razor cartridge including a plurality of blades, wherein the plurality of blades includes at least two blades having different thicknesses at their corresponding edge portions, wherein a first span between a first blade and a second blade among the plurality of blades is less than a second span between the second blade and a third blade among the plurality of blades, wherein a first distance between a contact member located in front of the plurality of blades and an edge portion of the first blade is less than a second distance between the contact member and an edge portion of the second blade, and wherein the second distance is less than a third distance between the contact member and an edge portion of the third blade.

BRIEF DESCRIPTION OF THE DRAWINGS

The above and other objects, features and other advantages of the present invention will be more clearly understood from the following detailed description taken in conjunction with the accompanying drawings, in which.

DETAILED DESCRIPTION OF THE INVENTION

Figure 1:
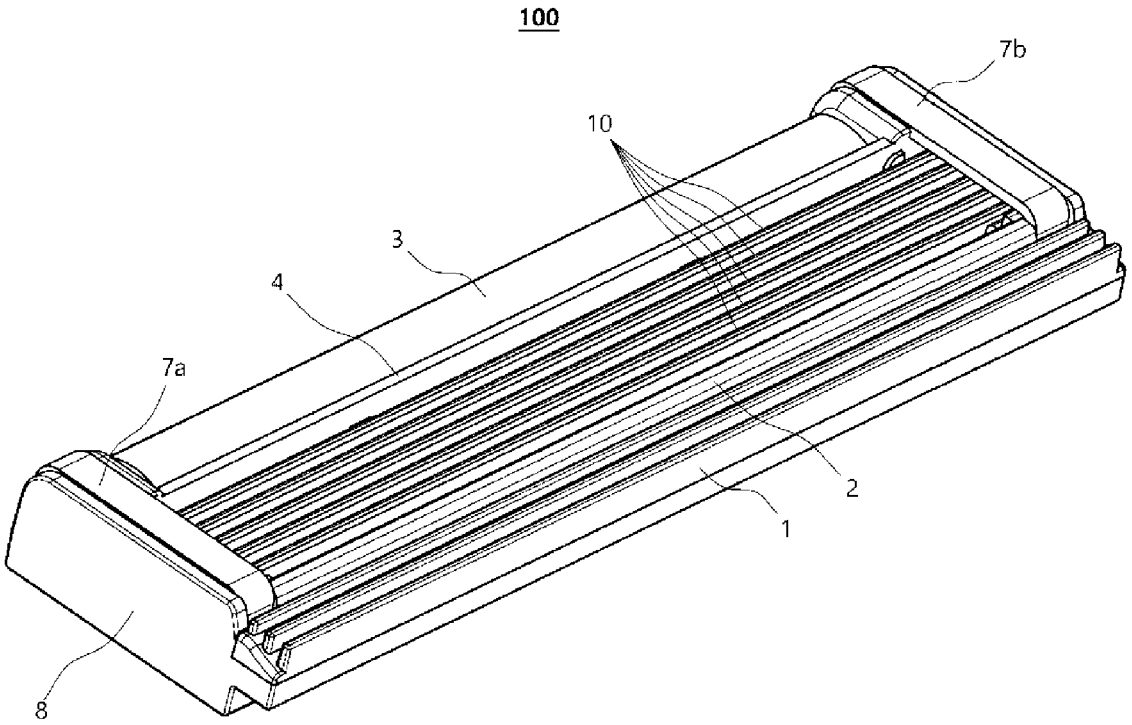
FIG. 1 is a perspective view of a razor cartridge according to an embodiment of the present invention.

The advantages and features of the present invention and the manner of achieving the same will become apparent from the embodiments described in detail below with reference to the accompanying drawings. The present invention may, however, be embodied in many different forms and should not be construed as limited to the embodiments set forth herein. It should be understood that these embodiments are provided such that the disclosure will be thorough and complete, and will fully convey the concept of the invention to those skilled in the art. The scope of the invention is only defined by the claims. Wherever possible, the same reference numerals will be used to refer to the same or like parts.

Unless defined otherwise, all terms (including technical and scientific terms) used in this specification may be construed as having meanings commonly understood by those skilled in the art. Terms defined in typical dictionaries should not be interpreted ideally or excessively.

Terms used in this specification are merely adopted to explain specific embodiments, and are not intended to limit the present invention. A singular expression encompasses a plural expression unless the two expressions are contextually different from each other. In this specification, "comprises" and/or "comprising" does not exclude presence or addition of one or more other elements in addition to the stated element. Hereinafter, an embodiment of the present invention will be described in detail with reference to the accompanying drawings.

FIG. 1 is a perspective view of a razor cartridge 100 according to an embodiment of the present invention.

Each of a plurality of razor blades 10 may have a tip edge at one end thereof, and the other end thereof may be seated in a seating slot provided in a blade housing 8. Here, the plurality of razor blades 10 includes one or more blades arranged in series in a shaving direction. The shaving direction refers to the direction from a front guard 2 to a rear cap 4.

In order to prevent the blades 10 from being separated from the blade housing 8, a pair of fixing clips 7*a* and 7*b* for fixing both ends of the blades 10 to the blade housing 8 may be provided. The fixing clips 7*a* and 7*b* are bent against the lower surface of the blade housing 8 and routed through the through holes formed near both ends of the blade housing 8, and wrapped around the ends of the blades 10. In the embodiment exemplified in FIG. 1, front legs of the fixing clips 7*a* and 7*b* are arranged through the through holes formed in the vicinity of the front end of the blade housing 8 and the rear legs of the fixing clips 7*a* and 7*b* wrap around the rear end of the blade housing 8. However, the present invention is not limited to this configuration. For example, both the front and rear ends may be wrapped around the blade housing, or the legs of both fixing clips may be routed through front and rear through holes and bent against the lower surface of the blade housing.

The plurality of razor blades 10 arranged in the blade housing 8 are flanked by the front guard 2 and the rear cap 4. An elastic member 1 may be arranged in front of the front guard 2 to be parallel to the blades 10 and a lubrication strip 3 may be arranged at the rear of the rear cap 4 to be parallel to the blades 10. The elastic member 1 erects the user's hair in a direction substantially perpendicular to the shaving direction to facilitate the cutting operation of the blades 10, and the lubrication strip 3 smooths rough skin after cutting. However, the present disclosure is not limited thereto. For example, the lubrication strip 3 may be arranged in front of the front guard 2 to be parallel to the shaving blades 10, and the elastic member 1 may be arranged at the rear of the rear cap 4 to be parallel to the blades 10. Alternatively, lubrication strips 3 or elastic members 1 may be arranged in front of the front guard 2 and behind the rear cap 4.

The plurality of blades 10 illustrated in FIG. 1 consist of five blades. However, the number of razor blades arranged in the razor cartridge 100 may be varied based on factors such as the shape and thickness of the blades 10, the span, the size of the razor cartridge, the purpose of shaving, and the like. Therefore, a greater or fewer number of razor blades may be arranged in the razor cartridge 100. It is understood that the razor cartridge includes a front blade adjacent to the front guard 2 and a rear blade adjacent to the rear cap 4, and may further include additional blades between the front and rear blades.

Figure 2:
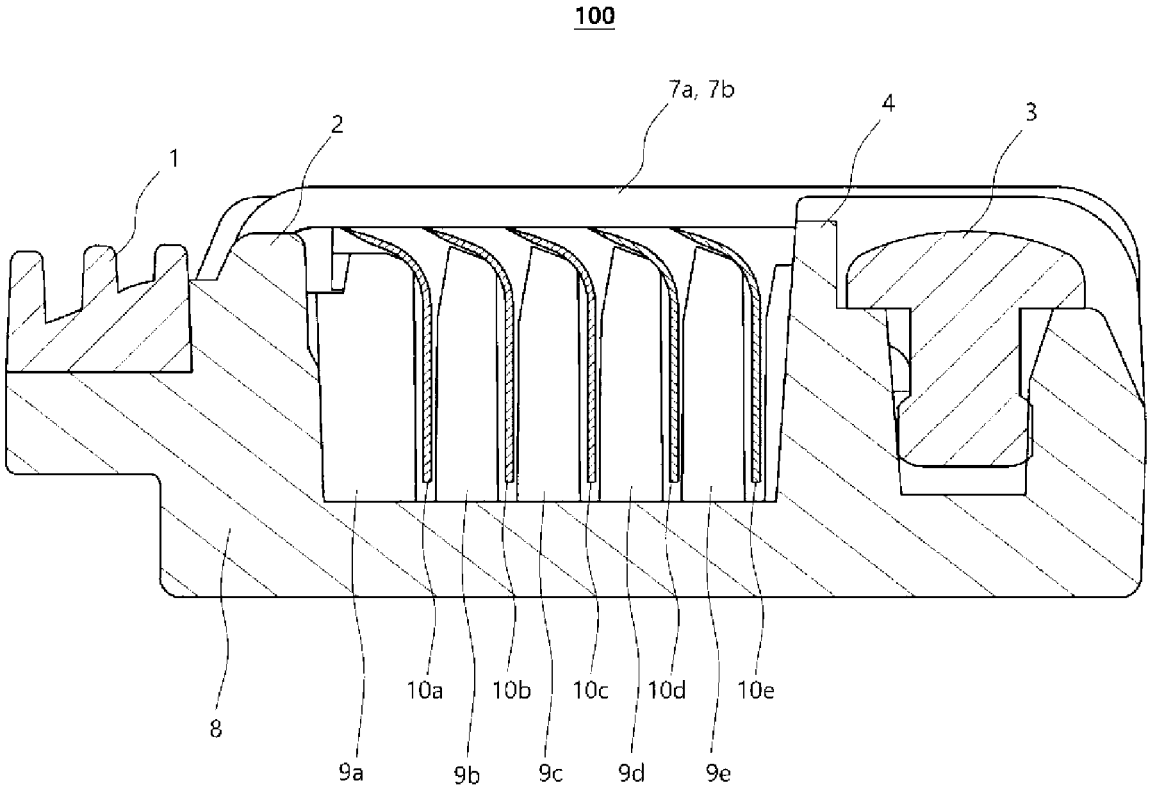
FIG. 2 is a longitudinal sectional view of a central portion of the razor cartridge of FIG. 1, taken in a shaving direction.

FIG. 2 is a sectional view of a central portion of the razor cartridge 100 of FIG. 1, taken in a shaving direction. Referring to FIG. 2, five blades 10*a* to 10*e* are respectively inserted in a corresponding gap (slot) formed between each of the seating projections 9*a* to 9*e*. Specifically, a part of the edge portion or the bent portion of the front surface of the blades 10*a* to 10*e* may be supported by a seating projection (for example, seating projection 9*a* for blade 10*a*) in front thereof. Further, the bases of the razor blades 10*a* to 10*e* may be supported between two seating projections (for example, seating projections 9*a* and 9*b* for blade 10*a*) located on the front and rear sides thereof.

As discussed, the razor blades 10*a* to 10*e* may be firmly installed in the blade housing 8 by a pair of fixing clips 7*a* and 7*b*, which press the tip edge of each blade downward at both ends thereof, while the blade is supported by the seating projections as described above.

A more detailed shape of embodiments of the blades 10 shown in FIG. 1 or 2 are described below with reference to FIGS. 3A and 3B.

Figure 3A:
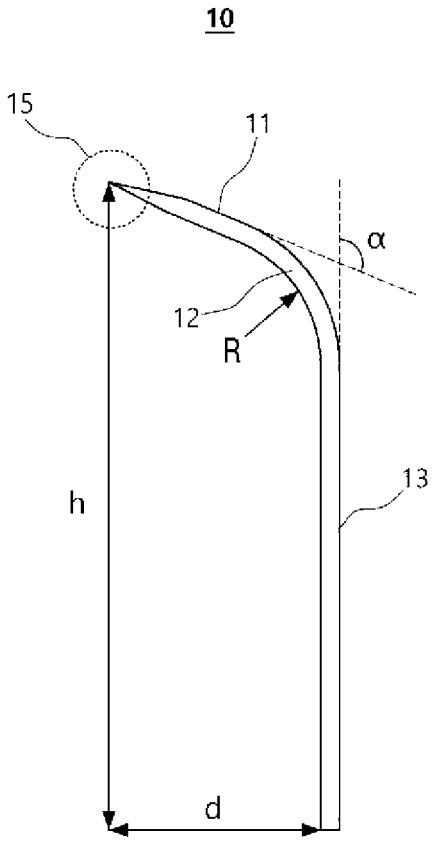
FIGS. 3A and 3B are views showing a more detailed shape of a razor blade shown in FIG. 1 or 2.

FIG. 3A is a side view of an integrated blade according to an embodiment of the present invention. Referring to FIG. 3A, an integrated blade 10 includes a base 13 seated in a slot of the blade housing 8, an edge portion 11 having a tip edge 15 at the front end thereof, and a bent portion 12 connecting the base 13 and the edge portion 11. The dimensions of the overall shape of the integrated blade include height h, depth d, radius of curvature R, and bending angle α.

For example, an embodiment of the integrated blade 10 may have a height h in a range of 1.5 mm to 5.0 mm, a depth din a range of 0.7 mm to 3.0 mm, a radius of curvature R in a range of 0.45 mm to 0.9 mm, and a bending angle α in a range of 90° to 170°. The integrated blade 10 may be manufactured in a process of bending a single body and may be designed to be as thick or as thin as needed. Accordingly, a plane corresponding to the edge portion 11 is not aligned with a plane corresponding to the base 13 as the blade is curved.

Figure 3B:
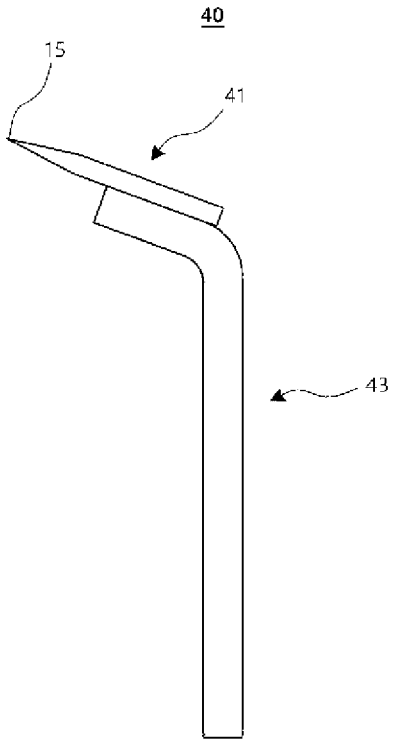

However, the present invention is not limited thereto, and the blade used in the present invention may be a joined blade 40 as shown in FIG. 3B. The joined blade 40 consists of two members including a metal base 43 seated in a slot of the blade housing 8 and an edge portion 41 coupled to the metal base 43 and having a tip edge 15. Like the integrated blade 10, the joined blade 40 has a base and a bent portion, and also has a blade attachment portion for supporting and joining the edge portion 41. The metal base 43 of the joined blade 40 may be formed thicker than or equal to the edge portion 41, and may thus firmly support the edge portion 41. Accordingly, the plane corresponding to the edge portion 41 is not aligned with a plane corresponding to the metal base 43 as the blade is curved.

In the following description, the blade according to the present invention is assumed to be the integrated blade 10 as shown in FIG. 3A. However, the present invention is not limited thereto. The present invention does not exclude a case where the blade is the joined blade 40 shown in FIG. 3B, a straight blade, or a blade having other shapes. However, using the integrated blade 10 or the joined blade 40 may be more appropriate than using the straight blade because the angle formed by the integrated blade 10 or the joined blade 40 with the skin is more favorable to shaving and less irritating to the skin.

Figure 4:
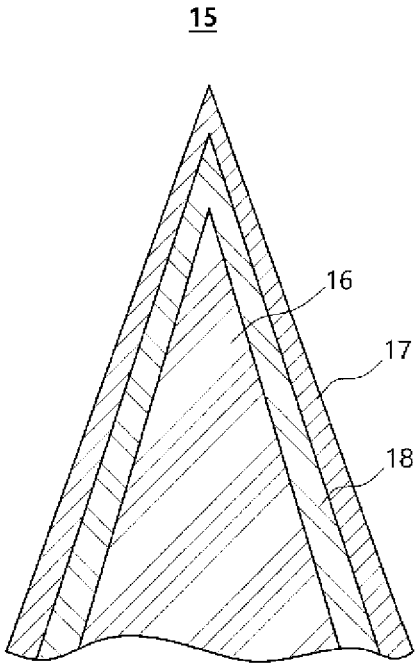
FIG. 4 is a longitudinal sectional view of a tip edge formed on a razor blade according to an embodiment of the present invention.

FIG. 4 is a longitudinal sectional view of a tip edge 15 formed on a razor blade 10, 40 according to an embodiment of the present invention. The tip edge 15 may include a substrate 16, an intermediate coating layer 18, and an outer coating layer 17, which are arranged from the innermost side in order. The substrate 16 is typically made of stainless steel, but other materials may be used. Further, a hard coating layer may be further provided on the outer surface of the substrate to increase the strength and corrosion resistance of the substrate 16. The hard coating layer may be formed of a carbon-containing material such as diamond-like carbon (DLC), a nitride, an oxide, or a ceramic material.

The intermediate coating layer 18 formed between the substrate 16 and the outer coating layer 17 is used to increase the strength of the blades 10 and 40 or to promote adhesion of the outer coating layer 17 to the substrate 16. The intermediate coating layer 18 may be formed using a carbon-containing material such as DLC, a nitride, an oxide, a ceramic, or a chromium-containing material.

Further, the outer coating layer 17 is formed on the outer surface of the tip edge 15 to reduce friction. The outer coating layer 17 may be formed using polyfluorocarbon, such as polytetrafluoroethylene (PTFE), as a polymer composition. Typically, PTFE acts as a nonflammable and stable dry lubricant composed of small particles that stably disperse.

Figure 5:
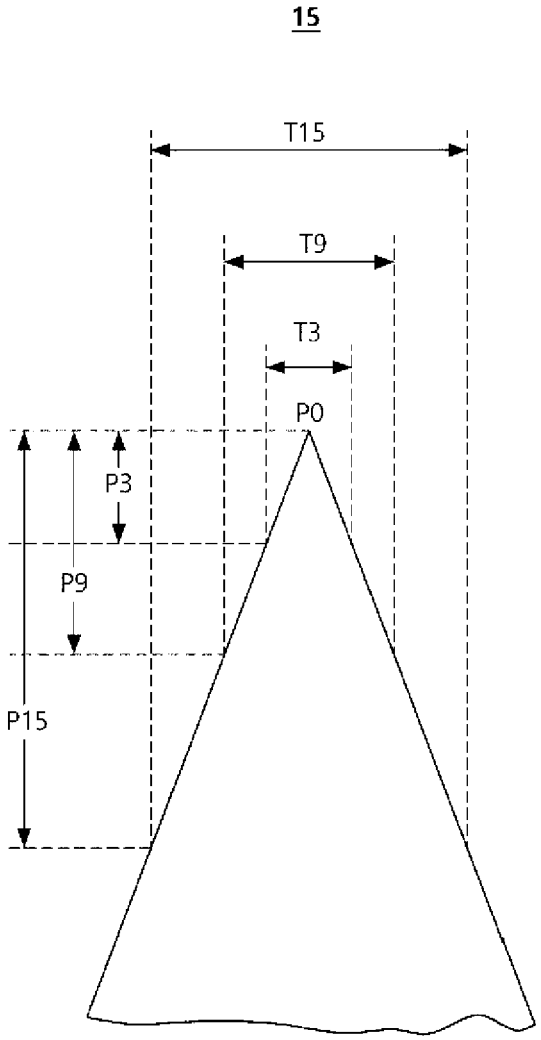
FIG. 5 is a view showing a thickness dimension of the tip edge shown in FIG. 4 at respective positions.

FIG. 5 is a view showing a thickness dimension of the tip edge 15 shown in FIG. 4 at respective positions. As shown in FIG. 5, the ultimate tip position of the tip edge 15 may be denoted by P0, where distances from the ultimate tip P0 are indicated by (i) expressed in micrometers (μm), where each point located at each distance (i) from P0 is indicated by Pi. Thus, in FIG. 5, P3, P9, and P15 indicate positions which are located 3 μm, 9 μm, and 15 μm from the ultimate tip position P0, respectively. The thickness of the blade at each of these positions is defined in a transverse dimension of the tip edge 15. For example, T15 means the transverse dimension (thickness) of the tip edge 15 at position of P15.

Since the properties such as shaving performance and strength of the blade are generally influenced greatly by the thickness profile of the tip edge 15, the properties of the desired blade may be determined by designing various thickness profiles.

According to an embodiment of the present invention, a relatively thin blade and a relatively thick blade may be arranged together in the blade housing 8. Here, the thin blade refers to a razor blade that has a relatively small thickness dimension compared to the thick blade at overall positions on the tip edge 15 and is thin and sharp as a whole compared to the thick blade while having low cutting force (cutting resistance) and low durability. Similarly, the thick blade refers to a blade that has a relatively large thickness dimension compared to the thin blade at overall positions on the tip edge 15 and is thick and less sharp as a whole compared to the thin blade while having high cutting force (cutting resistance) and high durability.

In one embodiment, the thickness profile of the tip edge for each of the thin blade and the thick blade may be designed as shown in Table 1 below.

TABLE 1

| | Thick blade | Thin blade |
|---|---|---|
| T3 | 1.2-1.6 μm | 1.0-1.5 μm |
| T9 | 3.6-4.4 μm | 3.0-3.8 μm |
| T15 | 5.7-6.7 μm | 4.7-5.7 μm |

As shown in Table 1, the thick blade generally has a greater thickness along the tip edge 15 than the thin blade, for example at positions located greater than 1 μm (P1) from the tip edge.

The profiles of the thick blade and the thin blade may be defined with a thickness dimension at position of Pi, and in some cases the important positions affecting change in the overall properties of the blade according to the thickness of the tip edge may be identified as P3, P9 and P15. Thus, by designing the blade thicknesses at these positions differently, thick and thin razor blades having various dimensions can be produced to produce a desired effect.

Such profile of a blade has a direct influence on the cutting force. For example, in Table 1, the thin blade has a Shaving Hair Cutting Force (SHCF)(%) lower than the SHCF of the thick blade by a value of at least 5%, preferably about 9.36%. The SHCF is an index for evaluating the cutting force known by those in the industry and indicates a relative value obtained by evaluating the force (gf) applied in cutting a hair strand. Therefore, SHCF is proportional to cutting force. In general, SHCF is indicated by "−" when the cutting force is small, and indicated by "+" when the cutting force is large. When the difference in SHCF is −5% or lower, it is determined that the shaving performance has been improved.

As such, the shape and thickness of the thin blade and the thick blade arranged in the razor cartridge 100 primarily affect shaving performance. The design of the spacing, namely, the span between individual blades arranged in the razor cartridge 100 in the shaving direction, also greatly affects the shaving performance. In particular, it is important to adaptively select suitable spans considering the characteristics of the blades.

Figure 6:
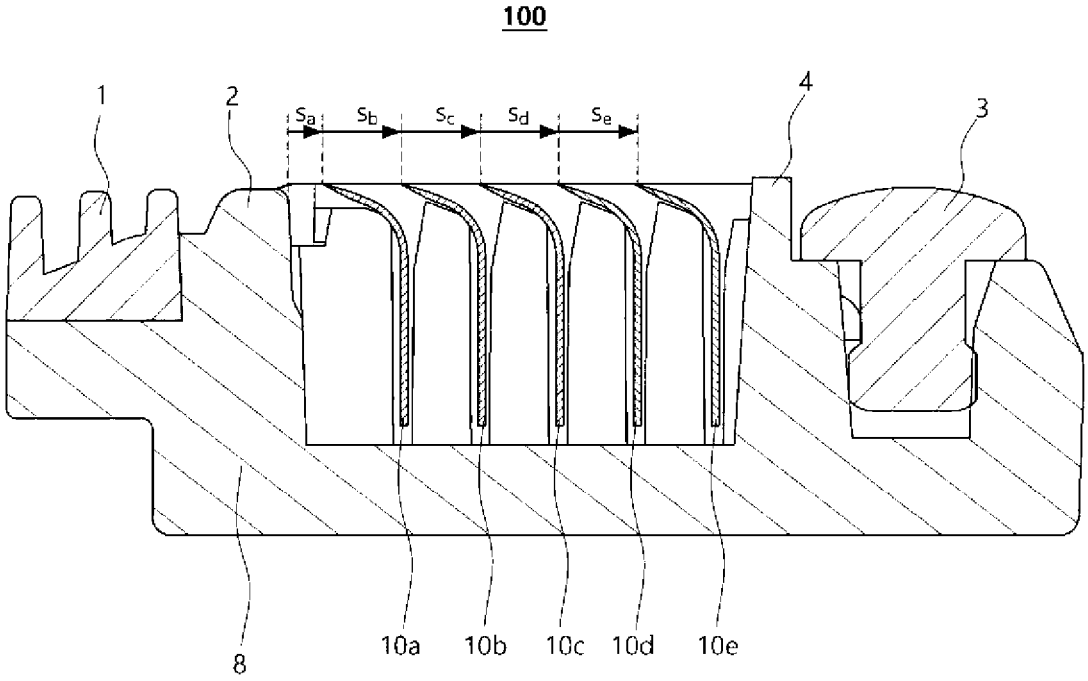
FIG. 6 is a view showing a span of a razor blade with fixing clips removed from the razor cartridge of FIG. 2.

FIG. 6 is a view showing spans $S_a$ to $S_e$ for respective blades with the fixing clips 7*a* and 7*b* removed from the razor cartridge 100 of FIG. 2. The spans may be designed differently for respective specific blades. A span for a particular blade may be defined as a horizontal distance between the tip edge 15 of a preceding blade and the tip edge 15 of the particular blade. For the first blade 10*a*, or for any other particular blade which does not have a preceding blade, the span is defined as a distance between the wall of the front guard 2 or other preceding non-blade member and the tip edge 15 of the first blade 10*a* or other particular blade without a preceding blade.

Generally, when the span is wide, it is advantageous for discharging a shaving aid, moisture or shaving debris, but it leads to increase in size of the razor cartridge and easily causes cuts during shaving. When the span is narrow, opposite effects are obtained. Therefore, it is important to select an appropriate span considering the shaving conditions, and the span also needs to be designed in accordance with the thickness of the blade. For example, the thin blade may be designed to have a relatively narrow span in order to reduce cuts of the skin, and the thick blade may be designed to have a relatively wide span in order to improve the discharge performance at the time of shaving. In particular, even if the thick blade has the same span as the thin blade, it may narrow the spacing between the preceding blades due to its own dimensions, and thus, the corresponding span needs to be widened. In addition, the thick blade is less sharp, has higher cutting force (cutting resistance) and durability. Accordingly, the thick blade is less worn and less likely to cause cuts or scratches on the skin even if the span becomes wider. Therefore, thick blades are more advantageous than thin blades in securing a wider span.

The blades 10*a* to 10*e* arranged in FIG. 6 include at least one thin blade and/or at least one thick blade. For example, the foremost blade 10*a* may be a thin blade and the rearmost blade 10*e* may be a thick blade. Since the foremost blade 10*a* is first brought into contact with the hairs during shaving, a thin razor blade having a low cutting force is arranged as the foremost blade. Since the rearmost blade 10*e* is the last blade that is brought into contact with the hairs, a thick blade having a high cutting force is arranged as the rearmost blade. The cutting force is conceptually the same as frictional resistance, such as SHCF described above, used in cutting hairs. However, the above-described arrangement is merely an embodiment of the present invention, and any other arrangement of the blades is also possible.

In the present invention, the thick blade may be defined as thicker than the thin blade in the overall area as suggested in Table 1 above, but the thick blade and the thin blade may be divided by a single reference of T15. T15 for the thin blade may be in the range of 5.2±0.5 μm, and T15 for the thick blade may be in the range of 6.2±0.5 μm. Thus, the thickness ratio of the thick blade to the thin blade based on T15 is approximately 1.0 to 1.5, preferably 1.15 to 1.5.

The reason for using T15 as a reference is that the cutting force and durability of the blade are most influenced by the value of T15 and the portions below P15 on the tip edge 15 are most involved in cutting.

Here, the span for the thick blade may be designed to be wider than the span for the thin blade. In general, a thinner tip edge has a lower cutting force (cutting resistance), but may cause skin irritation. Therefore, it is necessary to reduce the skin irritation by narrowing the span. In addition, a thicker tip edge is less likely to cause such skin irritation and has higher durability, and thus, may endure a larger load. Accordingly, by relatively increasing the span, the service life of the razor cartridge may be increased and discharge of shaving substances may be facilitated.

More preferably, the thick blade may be designed to have a wider span than a specific reference value and the thin blade may be designed to have a narrow span, based on a specific reference value (neutral value). The reference value may be set in various ranges, but may be selected in a range of 0.8 to 1.1 mm. Preferably, the reference value may be about 0.95 mm. For example, the narrow span for the thin blade is less than 0.95 mm, and the wide span for the thick blade is greater than 0.95 mm. In consideration of a practical span range, the narrow span may be limited to 0.5 mm or more, and the large span may be limited to less than 1.6 mm.

As such, design of the razor cartridge considering both the thickness and the span of the razor blades at the same time contributes to ensuring sufficient shaving performance while minimizing skin irritation, as well as to improving the durability and service life of the entire razor cartridge.

The numerical relationships discussed above may be summarized by Equations 1 to 3. First, Equation 1 represents the relationship between the thicknesses of the thick blade and the thin blade at position P15. This equation is determined only by the shape of the blades regardless of the span.

$$T15_B=(\alpha+1)*T15_A, 0.1<\alpha<0.5 \quad \text{Equation 1}$$

Here, T$\mathbf{15}_A$ denotes T15 of the thin blade and T$\mathbf{15}_B$ denotes T15 of the thick blade.

Further, the relationship between the span of the thin blade and the thickness at position P15, namely, T15, may be represented as Equation 2. According to Equation 2, as the span of the thin blade increases, T$\mathbf{15}_A$ should also increase.

$$T15_A=2.2*x+3.6, x:\text{span}, 0.5\leq\text{span}<0.95 \quad \text{Equation 2}$$

Here, T$\mathbf{15}_A$ denotes T15 (μm) of the thin blade, and x denotes the span (mm) of the thin blade. However, considering the range suitable for the actual shaving performance, the span has a margin of ±10%. That is, x may have a range of 0.9*span to 1.1*span. However, due to manufacturing tolerances, the value of T$\mathbf{15}_A$ of an actual product may not always satisfy Equation 2 and may have a value close to Equation 2.

The relationship between the span of the thick blade and T15 may be expressed as Equation 3. According to Equation 3, as the span for the thick blade increases, T$\mathbf{15}_B$ should increase.

$$T15_B=1.5*x+4.3, x:\text{span}, 0.95\leq\text{span}<1.6 \quad \text{Equation 3}$$

Here, T$\mathbf{15}_B$ denotes T15 (μm) of the thick blade, and x denotes the span of the thick blade (mm). Here, in consideration of a range suitable for the actual shaving performance, the span has a margin of ±10%. That is, x may have a range of 0.9*span to 1.1*span. However, due to manufacturing tolerances, the value of T$\mathbf{15}_B$ of the actual product may not always satisfy Equation 3 and may have a value close to Equation 3.

Figure 7:
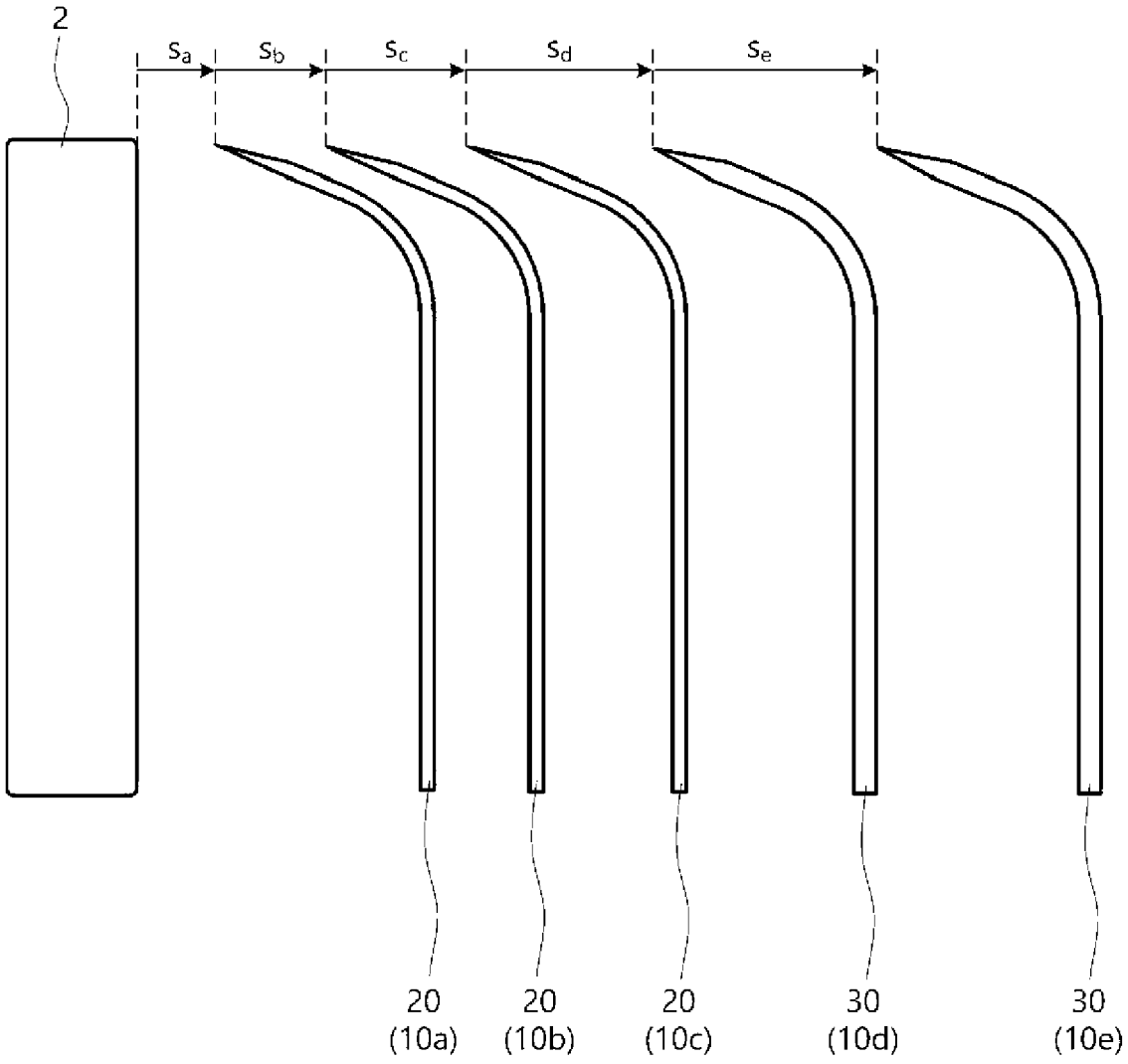
FIG. 7 is a view showing an embodiment in which spans with respect to a contact plane gradually increases among blades.

Various embodiments relating to blade arrangement, taking into account the correlation between the thickness and the span of the blades as described above, are shown in FIGS. 7 to 12. As described above, the thin blade may be defined as a blade with T15 of 5.2±0.5 μm, and the thick blade may be defined as a blade with T15 of 6.2±0.5 μm. Among the figures, FIG. 7 is a view showing an embodiment in which spans gradually increase among the blades. Referring to FIG. 7, the spans $S_a$ to $S_e$ of the blades 10*a* to 10*e* from the front to back of the razor cartridge gradually increase from the foremost blade 10*a* to the rearmost blade 10*e*.

In this arrangement, thin blades arranged at the front of the razor cartridge may allow for adequate shaving with low cutting resistance while reducing skin irritation, and thick blades arranged behind may ensure sufficient support stiffness and smooth discharge of shaving substances. In particular, shallow shaving is performed by the front blades, followed by deep shaving by the rear blades. Thereby, a balanced shaving stroke may be provided.

While FIG. 7 illustrates that three identical thin blades 20 are arranged at the front and two thick blades 30 are arranged at the rear, the present invention is not limited thereto. For example, five different razor blades may be arranged such that the thickness thereof gradually increases from the front to the back, the relative number of thin blades to thick blades may differ, or the positioning of thin blades and thick blades may also differ.

Figure 8:
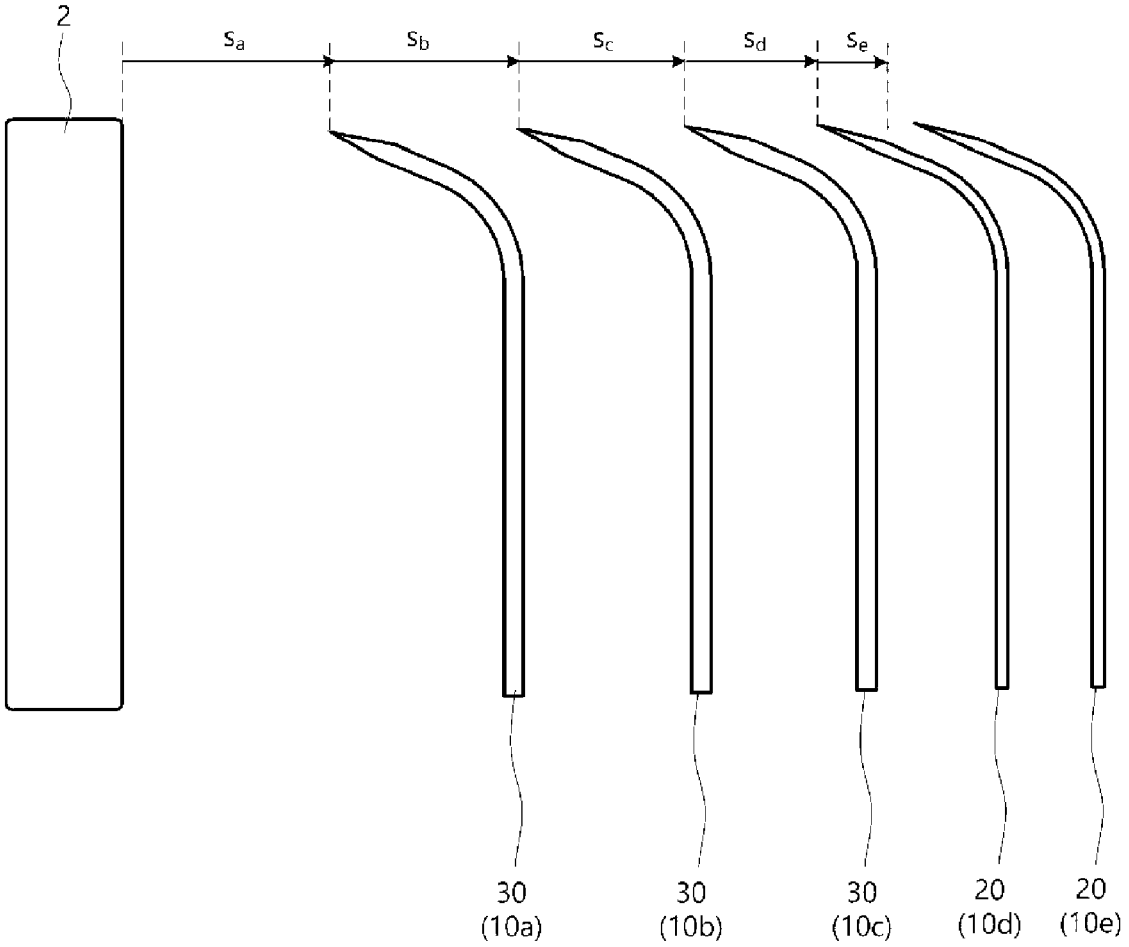
FIG. 8 is a view showing an embodiment in which spans with respect to a contact plane gradually decreases among blades.

Next, FIG. 8 is a view showing an embodiment in which spans gradually decreases among the blades. Referring to FIG. 8, the spans $S_a$ to $S_e$ of the blades 10*a* to 10*e* arranged from the front to back of the razor cartridge gradually decrease from the foremost blade 10*a* to the rearmost blade 10*e*.

In this arrangement, the blades arranged at the front of the razor cartridge may ensure sufficient support stiffness and smooth discharge of shaving substances, and the blades arranged behind may provide proper shaving with low cutting resistance while reducing skin irritation. Particularly, the front blades may perform shaving with high cutting force, and then the rear blades may finish shaving, making the skin clean and smooth.

While FIG. 8 illustrates that three identical thick blades 30 are arranged at the front and two thin blades 20 are arranged at the rear, the present invention is not limited thereto. For example, five different razor blades may be arranged such that the thickness thereof gradually decreases from the front to the back.

Figure 9:
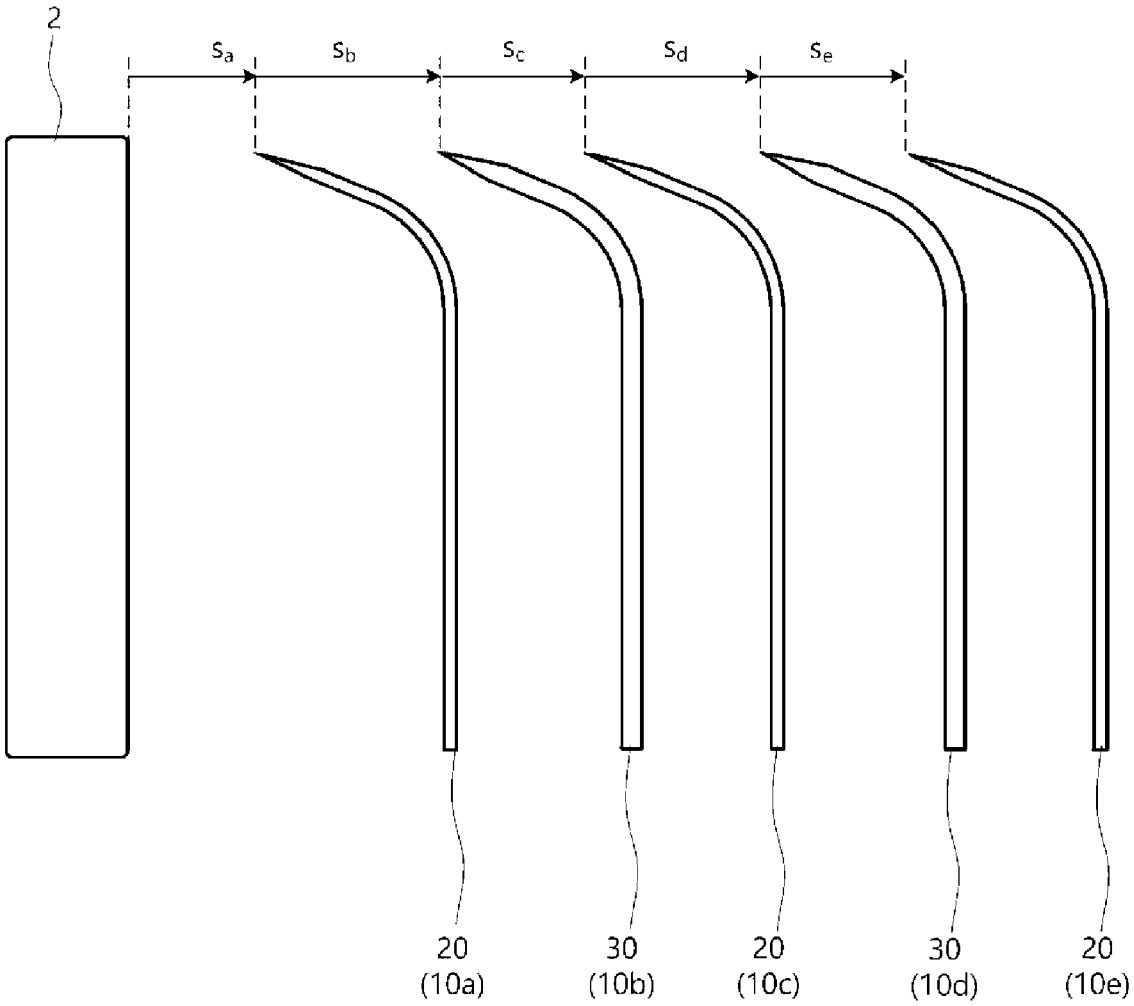
FIGS. 9 and 10 are views showing an embodiment in which spans of blades are formed in a zigzag pattern with respect to a contact plane.
Figure 10:
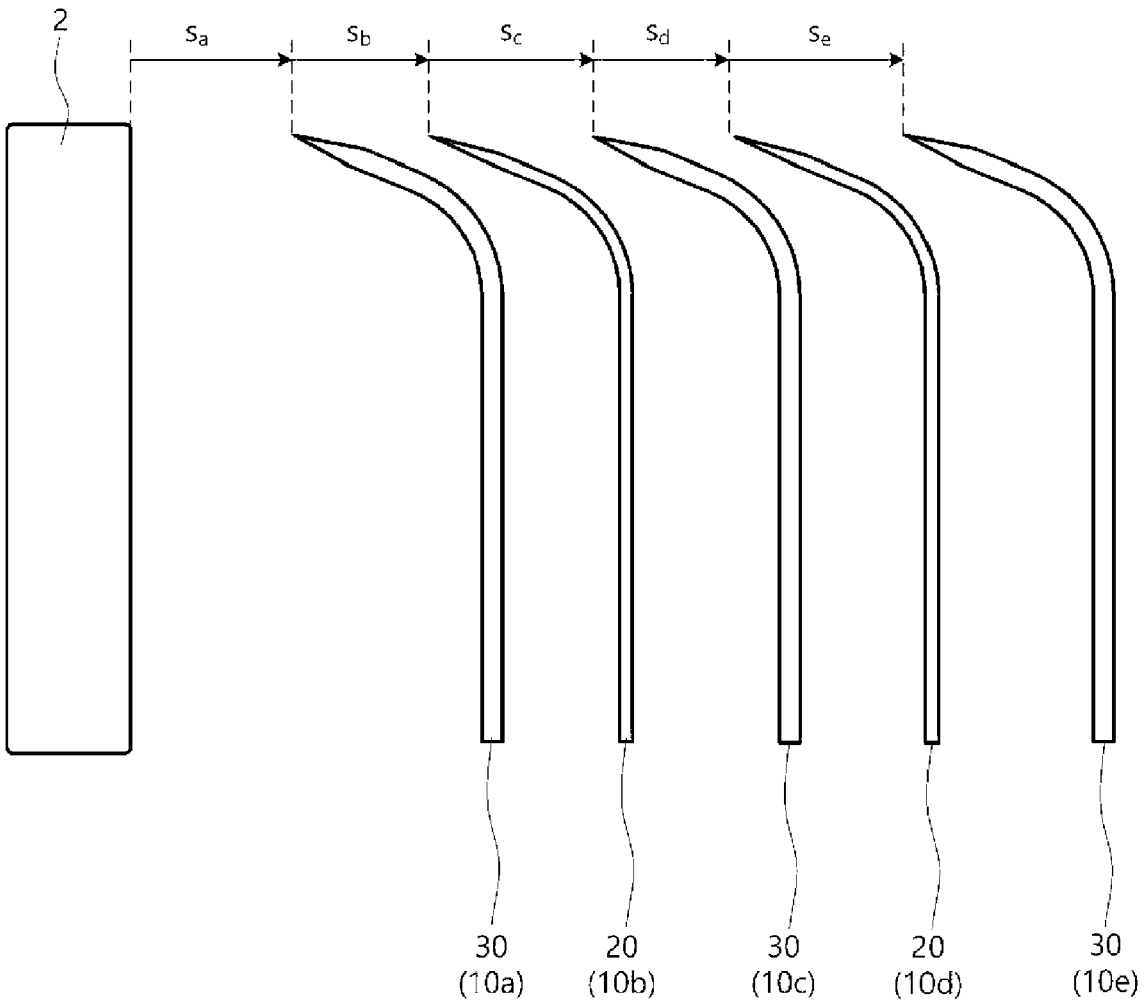

Next, FIGS. 9 and 10 are views showing an embodiment in which spans of the blades are formed in an alternating pattern. Referring to FIGS. 9 and 10, thin and thick blades 20 and 30 are alternately arranged from the front to the back of the razor cartridge, and the spans therefor are provided such that a wide span and a narrow span are alternately arranged. In FIG. 9, a thin blade 20 is arranged first at the front. In contrast, in FIG. 10, a thick blade 30 is arranged first at the front. In any case, the spans for the thick blades are wide spans and the spans for the thin blades are narrow spans.

When the thick and thin blades are alternately arranged to be adjacent to each other, the shaving characteristics of the thick blades and the shaving characteristics of the thin blades complement each other, and thus, the overall shaving performance may be improved.

Figure 11:
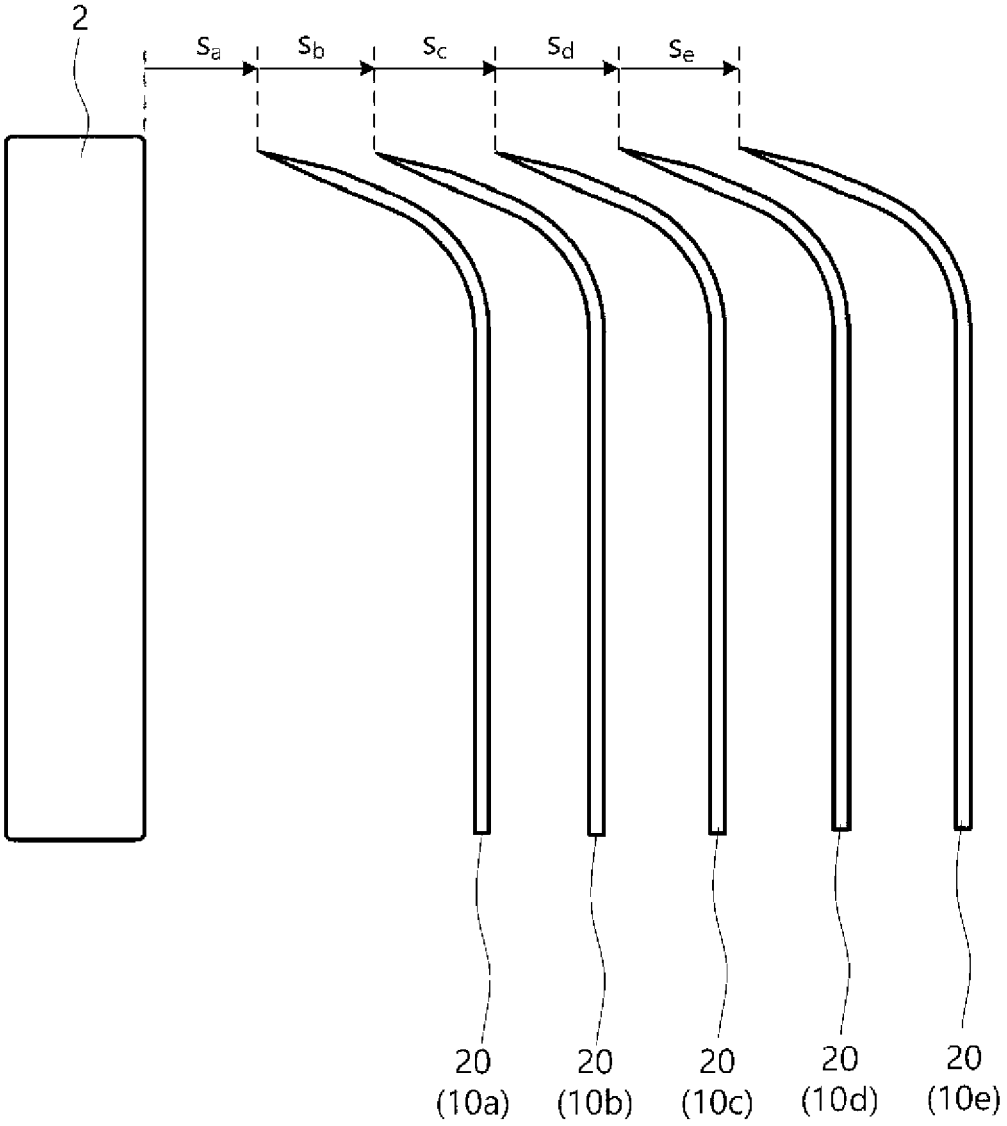
FIG. 11 is a view illustrating an embodiment in which spans of all blades with respect to a contact plane are narrow.
Figure 12:
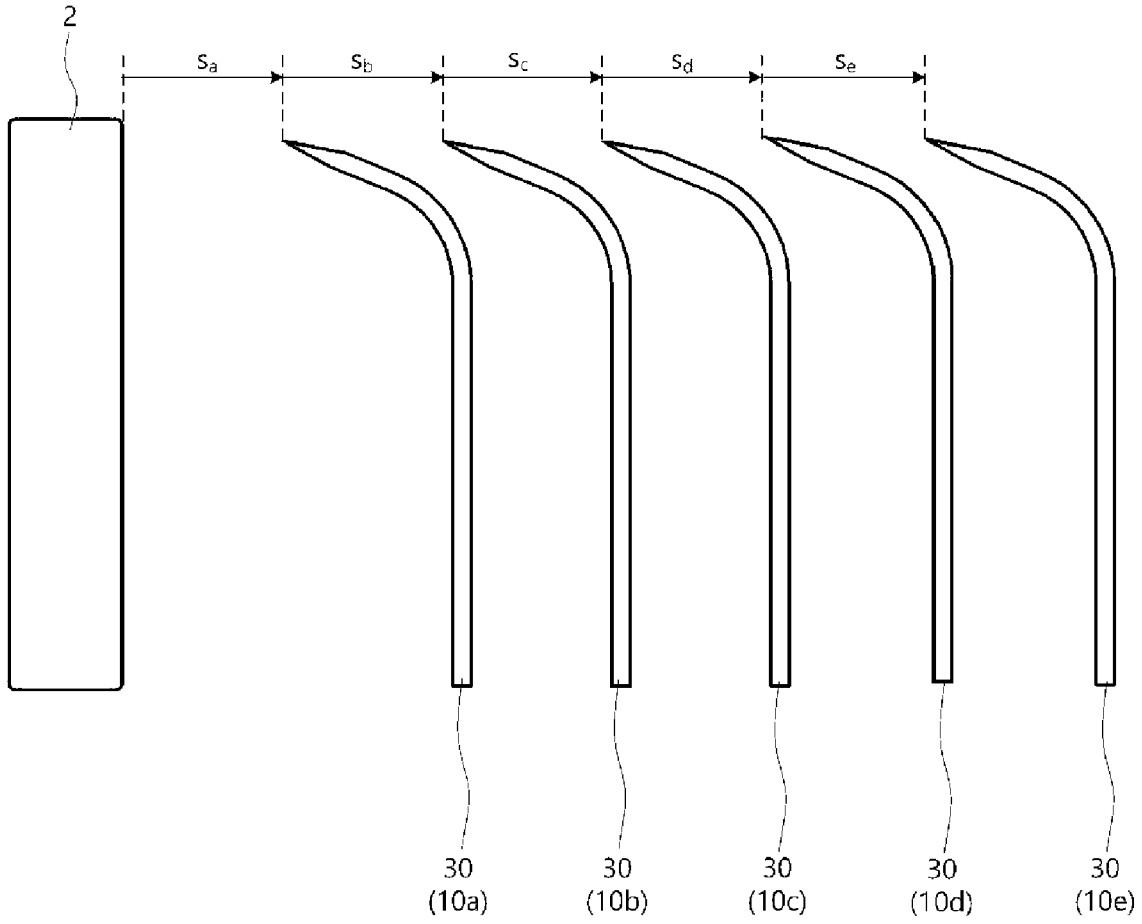
FIG. 12 is a view illustrating an embodiment in which spans of all blades with respect to a contact plane are wide.

FIGS. 11 and 12 illustrate a case where spans of all blades are narrow spans or wide spans. In FIG. 11, the blades are all thin blades and the spans therefor are narrow spans. Such thin blades having narrow spans reduce skin irritation and enables shaving with low cutting resistance. While it is illustrated in the figure that the thin blades have the same thickness and the same span, the present invention is not limited thereto. For example, when the thin blades have different thicknesses, the blades may have different spans.

In contrast to FIG. 11, FIG. 12 illustrates a case where the blades are all thick blades and have wide spans. The thick blades having wide spans provide increased durability and smooth discharge of shaving substances along with larger cutting force in shaving. While it is illustrated in the figure that the thick blades have the same thickness and the same span, the present invention is not limited thereto. For example, when the thick blades have different thicknesses, the blades may have different spans.

In any of the embodiments exemplified in FIGS. 7 to 12, the span and the thickness T15 of the five blades may be selected so as to satisfy the numerical range of at least one of the above-described Equations 1 to 3. However, the number of razor blades is not limited to five, but may be reduced or increased from five.

In the above embodiments, the razor cartridge 100 in which the blades 10 are arranged between the front guard 2 at the front and the rear cap 4 at the rear has been described. However, the present invention is not limited thereto. For example, the razor cartridge 110 may be provided with an additional guards or members (intermediate guard, third contact member, and the like) between the front guard 2 and the rear cap 4. Thus, when an intermediate guard is additionally formed in the middle of the razor cartridge 110, or other non-middle position in the cartridge, shaving safety may be enhanced along with decrease in nicks and cuts, and close contact with the skin may also be enhanced. Further, since different contact planes are provided in the front area formed between the front guard 2 and the intermediate guard and in the rear region formed between the intermediate guard and the rear cap 4, respectively, shaving with a variety of complex characteristics can be performed.

Figure 13:
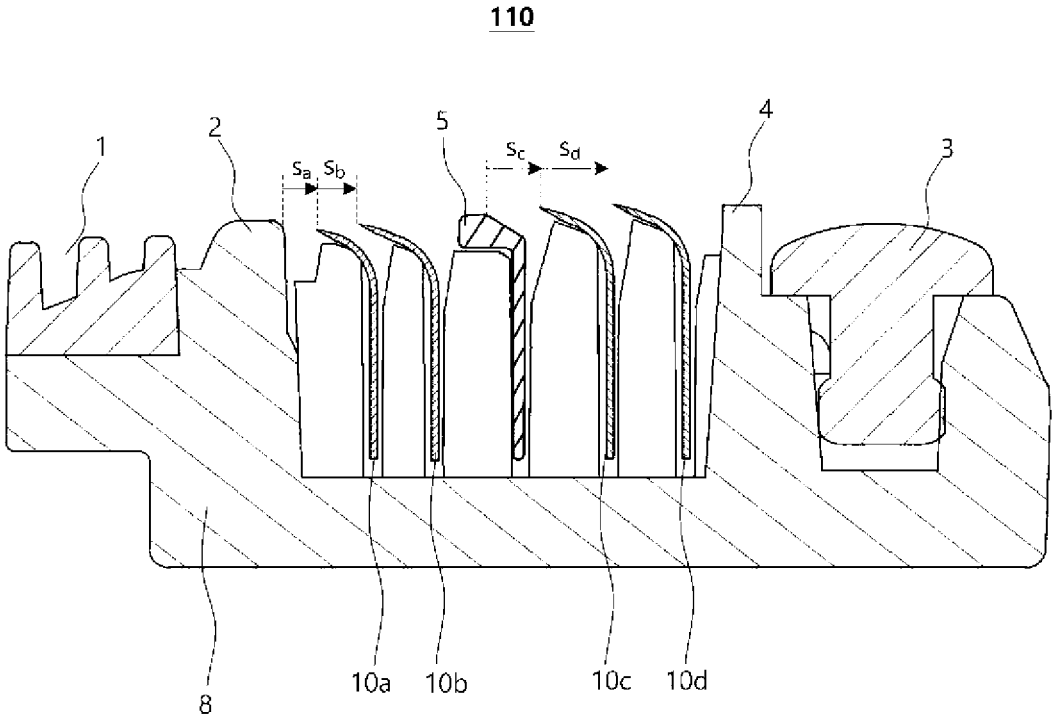
FIG. 13 is a cross-sectional view showing a razor cartridge according to another embodiment of the present invention.

FIG. 13 is a cross-sectional view showing a razor cartridge 110 according to another embodiment of the present invention. Referring to FIG. 13, four blades 10*a* to 10*d* are arranged in the blade housing 8, and an intermediate guard 5 is provided between two blades 10*a* and 10*b* in the front area and two blades 10*c* and 10*b* in the rear area. As shown in the figure, the intermediate guard 5 may be mounted between the seating projections in a similar manner to mounting of the blades 10*a* to 10*d*. However, the present invention is not limited thereto. For example, the intermediate guard may be provided in the form of a partition wall integrated with the blade housing 8.

According to an embodiment related to FIG. 13, the blades 10*a* and 10*b* arranged between the front guard 2 and the intermediate guard 5 are relatively thin blades (e.g., blades having T15 of 5.2±0.5 μm), and the blades 10*c* and 10*d* arranged between the intermediate guard 5 and the rear cap 4 are relatively thick blades (e.g., blades having T15 of 6.2±0.5 μm). In this case, the thin blades 10*a* and 10*b* in the front area have relatively narrow spans, while the thick blades 10*c* and 10*d* in the rear area have relatively wide spans. For example, the spans Sa and Sb of the thin blades 10*a* and 10*b* are less than a reference value (e.g., 0.95 mm), and the spans Sc and Sd of the thick blades 10*c* and 10*d* are greater than the reference value.

Thus, in actual shaving, primary cutting is performed by the thin blades, and then secondary cutting is performed by the thick blades. As a result, the thin blades in the front area may provide proper shaving with low cutting resistance while reducing skin irritation, and the thick blades 10*c* and 10*d* arranged behind may ensure sufficient support stiffness and durability.

According to another embodiment related to FIG. 13, the blades arranged in at least one of the front area and the rear area includes a thin blade having a first span (e.g., a blade with T15 of 5.2±0.5 μm), and a thick blade having a span wider than the first span (e.g., a blade with T15 of 6.2±0.5 μm).

As a more specific example, the blades 10*a* and 10*b* in the front area may be arranged in order of a thin blade followed by a thick blade (or vice versa), or the blades 10*c* and 10*d* in the rear area may be arranged in order of a thin blade followed by a thick blade (or vice versa). Of course, in this case, it is preferable to arrange the blades such that the span associated with the thick blade is wider than the span associated with the thin blade.

In the embodiment of FIG. 13, the spans and thicknesses of the four blades at T15 may be selected so as to satisfy the numerical range of at least one of the above-mentioned Equations 1 to 3. In addition, the number of razor blades is not limited to four. Therefore, the number of blades in the front area and the number of blades in the rear area may be equally one or three or more. Alternatively, the number of blades in the front area may be different from the number of blades in the rear area.

In the foregoing, description has been given of embodiments in which a plurality of blades is designed and arranged considering that shaving performance varies depending on the correlation between the thickness and the span of the blades. The shaving performance may be further improved by additionally considering a correlation between the thickness and the span of the blades.

Figure 14:
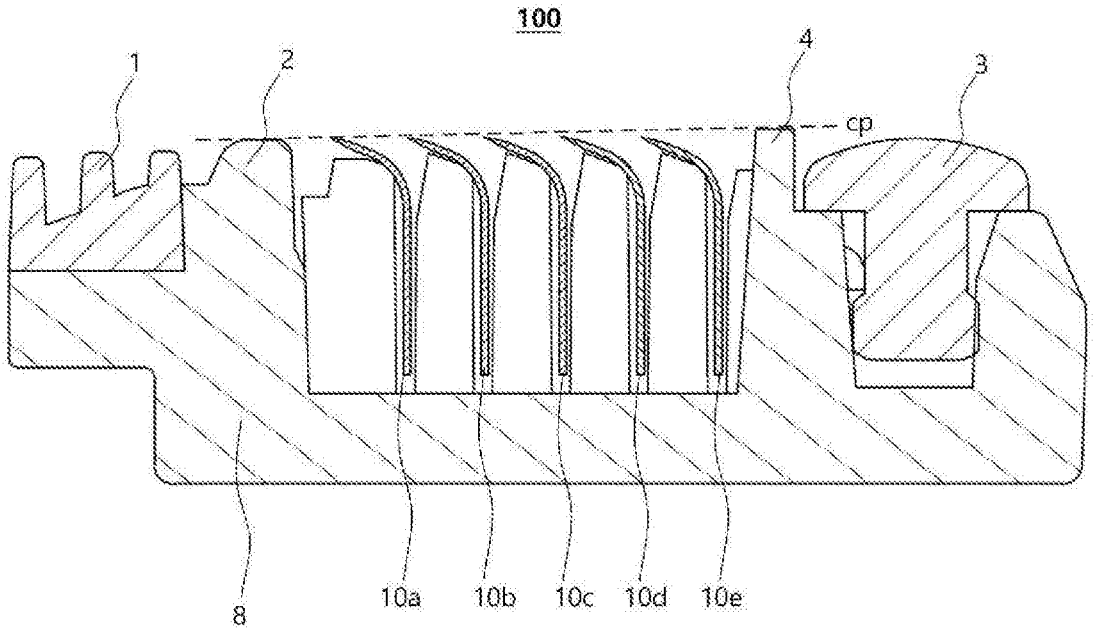
FIG. 14 is a view showing a positional relationship between a contact plane of a razor cartridge and each of tip edges of blades according to an embodiment of the present invention.

FIG. 14 is a view showing a positional relationship between the contact plane cp of the razor cartridge and each of the tip edges of the blades. The contact plane cp is a virtual plane defined by connecting the upper end of a first contact member located in front of the blades and the upper end of a second contact member located behind the blades. The contact plane cp is shown as a line in a cross-sectional view of FIG. 14. The exposure of a blade is a relative value indicating the position of the tip edge of the blade with respect to the contact plane, and may be divided into three types, i.e., positive, neutral and negative.

Here, the exposure of the thick blade may be designed to be larger than the exposure of the thin blade. In a specific example, the blades may be designed such that the thick blade has a positive exposure and the thin blade has a negative exposure. In general, as the tip edge becomes thinner, the cutting force (the cutting resistance) is lowered, but skin irritation may be caused. Therefore, it is necessary to reduce skin irritation while making the cutting work easier by relatively reducing the exposure. In addition, if the tip edge is thick, it may have high durability, and thus, may withstand a larger load. Accordingly, the cutting effectiveness and service life of the razor cartridge may be increased by relatively increasing the exposure.

In a razor cartridge according to embodiments of the present invention, a relatively thin blade is arranged at a position where the span is less than a reference value and a relatively thick blade is arranged at a position where the span is greater than the reference value. Thereby, shaving substances may be smoothly discharged during shaving while reducing damage to the skin such as skin irritation and cuts. Therefore, both shaving comfort and shaving efficiency may be improved.

Further, in the razor cartridge according to embodiments of the present invention, the thick blade, which is arranged at a position having a large span, may secure sufficient cutting force and increase the service life and durability of the razor cartridge.

While the embodiments of the present invention have been described with reference to the accompanying drawings, it should be understood by those skilled in the art that various modifications may be made without departing from the scope of the present invention and without changing essential features thereof. It is therefore to be understood that the embodiments described above are in all respects illustrative and not restrictive.

In addition, the dimensions and values disclosed herein are not to be understood as being strictly limited to the exact numerical values listed. Unless otherwise specified, each of such dimensions is intended to include both the enumerated value and a functionally equivalent range around that value.

What is claimed is:

1. A razor cartridge comprising:

a blade housing; and a plurality of blades comprising a first blade and a second blade, wherein a thickness of an edge portion of the first blade is less than a thickness of an edge portion of the second blade, wherein a first span for the first blade is less than a second span for the second blade, and wherein the following equation represents a relationship between the thickness and the span of the second blade:

$$T15_B=1.5*10^{-3}*X_B+4.3, 0.9*Y_B \leq X_B 1.1*Y_B,$$
$$950 \leq Y_B < 1600,$$

where:

T15$_B$ denotes T15 of the second blade;

T15 is a thickness (μm) of a tip edge of the second blade at position P15;

P15 indicate a position located 15 μm from an ultimate tip position P0 of the tip edge;

$X_B$ is the second span (μm) of the second blade; and $Y_B$ is a second reference span (μm) of the second blade.

2. The razor cartridge according to claim 1, wherein the first span satisfies a range of 0.5 mm to 0.95 mm.

3. The razor cartridge according to claim 1, wherein a shaving hair cutting force (SHCF) of the first blade is less than a SHCF of the second blade by at least 5%.

4. The razor cartridge according to claim 1, wherein each of the plurality of blades comprises an edge portion and a base, and wherein a plane corresponding to the edge portion is not aligned with a plane corresponding to the base.

5. The razor cartridge according to claim 4, wherein each of the plurality of blades further comprises a bent portion between the edge portion and the base.

6. The razor cartridge according to claim 1, wherein the first blade is located at a foremost position among the plurality of blades and the second blade is located at a rearmost position among the plurality of blades.

7. The razor cartridge according to claim 1, wherein the plurality of blades comprises thin and thick blades which are alternately arranged such that at least one thin blade is positioned between two thick blades or at least one thick blade is positioned between two thin blades.

8. The razor cartridge according to claim 7, wherein the thin blade is located at a foremost position among the plurality of blades.

9. The razor cartridge according to claim 7, wherein the thick blade is located at a foremost position among the plurality of blades.

10. The razor cartridge according to claim 1, further comprising:

a first contact member arranged in front of the plurality of blades with respect to a shaving direction; and a second contact member arranged behind the plurality of blades with respect to the shaving direction, wherein a first exposure of the first blade and a second exposure of the second blade defined with respect to a contact plane aligned with the first contact member and the second contact member are different.

11. The razor cartridge according to claim 10, wherein the second exposure is larger than the first exposure with respect to the contact plane.

12. The razor cartridge according to claim 1, wherein, at positions located 15 μm from each corresponding blade tip, a thickness of the first blade satisfies a range of 4.7 μm to 5.7 μm and a thickness of the second blade satisfies a range of 5.7 μm to 6.7 μm.

13. The razor cartridge according to claim 1, further comprising:

a first contact member arranged in front of the plurality of blades with respect to a shaving direction;

a second contact member arranged behind the plurality of blades with respect to the shaving direction; and a third contact member arranged between the first contact member and the second contact member, wherein at least a first one of the plurality of blades is arranged in a front region between the first contact member and the third contact member and at least a second one of the plurality of blades is arranged in a rear region between the third contact member and the second contact member.

14. The razor cartridge according to claim 1, wherein spans of the plurality of blades gradually increase from a foremost blade thereof to a rearmost blade thereof among the plurality of blades.

15. The razor cartridge according to claim 1, wherein the plurality of blades comprise at least two blades each having an edge portion with a first thickness and at least two blades each having an edge portion with a second thickness that is different from the first thickness.

16. The razor cartridge according to claim 1, wherein each of the first and second blades comprises a base coupled to their corresponding edge portions, and wherein thicknesses of the bases of the first and second blades are different.

17. The razor cartridge according to claim 16, wherein each of the bases is coupled to the corresponding edge portion by a corresponding bent portion, and wherein each of the edge portions comprises a tip edge for cutting hair.

* * * * *